United States Patent [19]

Shorter, Jr.

[11] 3,967,569

[45] July 6, 1976

[54] FLOATING DOCK

[76] Inventor: Myron L. Shorter, Jr., 81 Calypso Shores, Ignacio, Calif. 94947

[22] Filed: Dec. 30, 1974

[21] Appl. No.: 537,602

[52] U.S. Cl. ..... 114/.5 F
[51] Int. Cl.[2] ..... B63B 35/38
[58] Field of Search ..... 114/.5 BD, .5 F, 27, 114/65 A, 77 R

[56] References Cited

UNITED STATES PATENTS

| | | | |
|---|---|---|---|
| 3,289,621 | 12/1966 | Sebring | 114/.5 F |
| 3,446,172 | 5/1969 | Morton et al. | 114/.5 F |
| 3,448,709 | 6/1969 | Hardwick | 114/.5 F |
| 3,785,312 | 1/1974 | Schneider | 114/.5 F |

*Primary Examiner*—Trygve M. Blix
*Assistant Examiner*—Gregory W. O'Connor
*Attorney, Agent, or Firm*—Theodore J. Bielen, Jr.; Richard Esty Peterson

[57] ABSTRACT

A floating wharf structure has a plurality of adjacent arranged interconnected float units, each float unit comprising an enclosed substantially rectangular shell structure. A device for interconnecting the float units comprises flange structures projecting from the sides of the float units having horizontal top and bottom mounting surfaces which cooperate with upper and lower stringers mounted respectively against the top and bottom mounting surfaces of the flange structures. These stringers extend longitudinally along a portion of the flange structures of at least two adjacent float units. Fastening devices vertically extend through said flange structures and the upper and lower stringers for securing upper stringers, flange structures and lower stringers together in compression.

12 Claims, 3 Drawing Figures

FLOATING DOCK

BACKGROUND OF THE INVENTION

This invention relates to concrete floating wharf structures of the type comprising a plurality of individual float units which are interconnectable to form a walkway. Floating wharf structures have gained a wide acceptance in modern marinas and boat harbors as the most practical means of docking and mooring small craft in tidal waters or in other waters where the water level changes. The use of a floating wharf structure permits the level of the wharf structure and hence the walkway to maintain itself at a relatively constant height with respect to the craft docked or moored. This relatively constant positioning simplifies the tying or mooring operation and naturally maximizes the convenience in boarding.

The use of multiple individual float units or pontoons allows a versitility in the modular arrangement of the overall wharf structure. For example, a central walkway constructed with a series of projecting side fingers forming boat slips is a common arrangement of float units in wharf structures.

In particular, this invention relates to a means of interconnecting the individual float units that provides as nearly a rigid connection as possible. In prior art devices, interconnections have been devised which provide a degree of flexibility between float units. The means of interconnection for these devices have usually comprised one or more stringers, customarily fabricated from wooden tie rails of rectangular cross section, fastened flat against a part of the vertical sides of two or more adjacently arranged float units. The stringers have customarily been fastened by anchor bolts imbedded in the concrete structure of the float units. It has been discovered that the continuous flexing of the tie rails transmits substantial forces on the anchor bolts causing the bolts to fail, or more commonly, causing the bolts to work loose in the concrete, occasionally pulling out. When a bolt fails or works loose, the difficulty in replacing or reanchoring the bolts ofer requires that the entire float unit be replaced as a matter of expedience. While certain improvements in the method of anchoring bolts have been devised to reduce the frequency of failures in the anchoring of such bolts, such improvements have not totally alleviated the problem.

It has therefore become an objective to eliminate, to the extent possible, any flexure between adjacent float units, thereby eliminating the cause leading to the failures. Furthermore, in the case where extreme conditions, such as storms, cause failures in the anchor bolts, and in some cases the stringers themselves, it is a desirable objective to provide a construction that allows a simple replacement of the bolts and for the stringers.

SUMMARY OF THE INVENTION

The floating wharf structures of this invention are comprised of a plurality of individual float units interconnected to form a walkway. The float units are interconnected in modular fashion by stringers arranged in spaced pairs along the outer periphery of the wharf structure. The individual float units are constructed with a top, a bottom and walls forming a generally rectangular box-like configuration having a flange around at least the outer side edges of the overall wharf structure providing both a cooperative means with the stringers for interconnecting the float units and providing a buffer to protect the body of the float unit from impact from floating objects and crafts. Preferably, the float units are fabricated from concrete and may be either hollow or filled with a flotation material such as polystyrene foam. Generally, concrete float units of this type include reinforcing steel. However, the units can be constructed without reinforcing steel, particularly when mold-fabricated around an integral block of polystyrene foam.

The flange comprises a thickened portion of the outer sidewalls which may comprise the entire outer sidewalls of the float units or preferably a segment of the sidewall proximate to the top surface. While the end walls may include flanges which mutually abut when the units are interconnected, such end wall flanges are not necessary to this invention.

The flanges on the sidewalls space the pairs of stringers which interconnect the float units. The stringers are arranged on the top and bottom of the flanges such that the flanges are sandwiched therebetween. By constructing a flange as an integral, but projecting, segment of the sidewalls proximate to the top surface of the float units, as in the preferred embodiment, both stringers are elevated above the water level, thereby avoiding the problem of accelerated corrosion and wood decay.

The upper and lower stringers on the flange of each sidewall are elongated and run between adjacent float units. These two stringers are mutually connected by bolts extending through both stringers and the flange. Nuts at the end of the bolts compress the stringers and flanges together and thereby tie adjacent float units together. To adequately secure the stringers to multiple float units, it is preferred that the stringers be at least the length of a single float unit and extend from the center of the sides of one float unit to the center of the sides of an adjacent unit. The length of a stringer may, of course, extend the length of multiple units terminating at the center of the side flanges of distally spaced float units. In such instances, additional strength can be obtained by staggering the ends of the stringers such that the ends of the two adjacent stringers are not aligned.

The vertical spacing between the pairs of stringers on each side of the float units is designed to place one of the stringers in direct compression when a flexure of the wharf structure is attempted. For example, when wave action causes a vertical lifting force vector at the juncture of two adjacent float units, the upper of the two stringers is placed in tension and the lower is placed in direct compression. It is the direct compression which contributes most to the rigidity of the overall wharf structure. To compensate for the relatively weaker tensile strength of the stringers, thin steel straps are included in the preferred embodiment and arranged flat against the underside of the upper stringer and the upperside of the lower stringer. The steel straps need extend only a short length along the stringers connecting with at least the first of the series of bolts proximate the juncture of adjacent float units.

To protect the stringers and flange from contact from boats and other floating craft, and in turn to protect the boats and floating craft from an exposed concrete edge of the flange, a wooden side rail or bumper is attached to the sides of the float unit to act as a buffer. Since the wooden side rail need perform no structural function in maintaining the interconnection of adjacent float units, it is constructed in segments running the length of each float unit and is fastened to the stringers by nails. Other materials or arrangements to perform the protective function may be utilized, such as a rubber or polyurethane foam strips.

DETAILED DESCRIPTION OF THE PREFERRED EMBODIMENT

Figure 1:
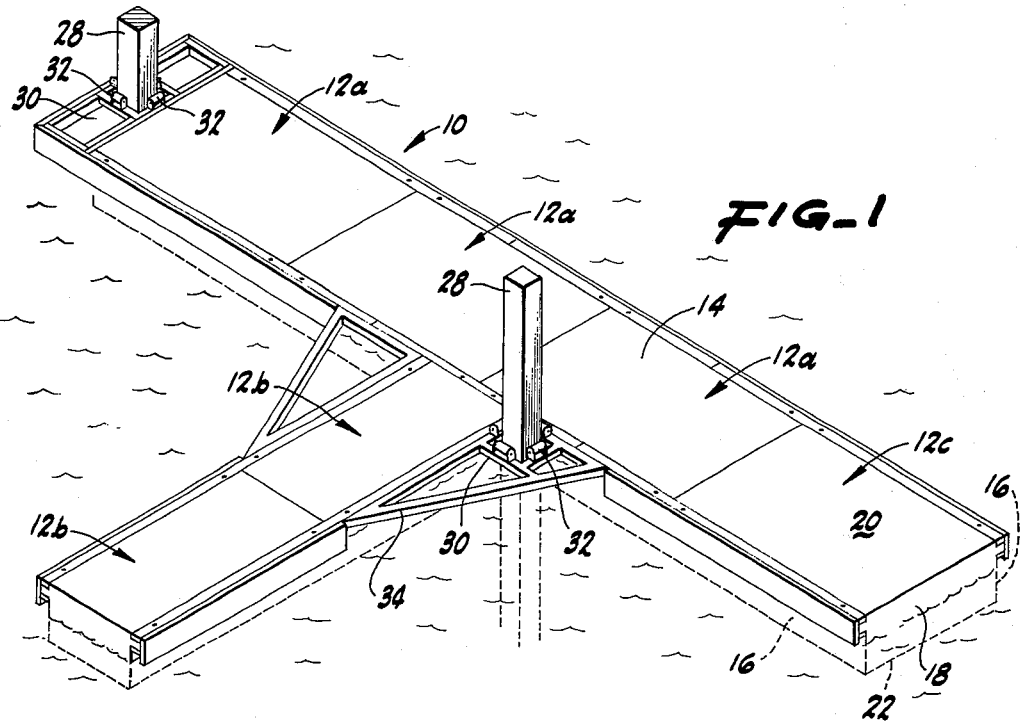
FIG. 1 is a perspective view of a sharf structure having a plurality of interconnected float units.

Referring to the perspective view of FIG. 1, a wharf structure designated generally by the reference numeral 10 is shown comprised of a plurality of interconnected individual float units 12*a*, 12*b* and 12*c*. The float units are each constructed of an enclosed concrete shell 13 with a flat top surface 14 which forms a walkway when the individual units are interconnected. As exemplified by the end unit 12*c*, the float units are generally rectangular with opposed sidewalls 16, end walls 18, a top 20 and a submerged bottom 22. Adjacent the top edge of the sidewalls is an integral, projecting portion of the sidewall. This projecting portion or flange 24 on each side of the float units cooperates with a pair of elongated stringers 26*a* and 26*b* and a series of vertically oriented bolts 27 to interconnect adjacent units.

In such a manner, as many of the modular units may be joined as desired to form a wharf structure of varied configuration. The entire wharf structure, because of the substantially rigid interconnection of the units, floats as a single entity. In a tidal environment, the wharf structure is preferably anchored by engaging one or more stationary pilings 28 with a bracket structure 30 having a plurality of rotationally attached rollers 32. The rollers 32 ride against the pilings as the wharf structure rises and falls with the tide. As shown in FIG. 1, the bracket structure 30 on which the rollers 32 are mounted, may be constructed in a corner brace 34 or in a projecting end structure 36. The corner braces 34 are naturally installed to rigidly secure the perpendicularly arranged side branch to the remaining wharf structure. As shown, the float units 12*b* of the side branch may, for purposes of economy and space saving, be smaller in width than the units 12*a* and 12*c* of the remaining wharf structure. The manner of interconnecting adjacent float units with abutting ends is, however, the same.

To protect the wharf structure from damage from floating objects, the sides of the flotation units are faced with a wooden buffer rail 38. Conversely, the buffer rail 38 naturally protects boats from the projecting concrete flange 24 sandwiched between the stringers. The buffer rail 38 is simply nailed against the exposed side face of the connecting stringers 26*a* and 26*b*. Since it is not necessary that the buffer rail 38 be structural in nature, but merely a protective member, the length of the buffer rail may be the length of a single unit or any length that is convenient for assembly.

Figure 3:
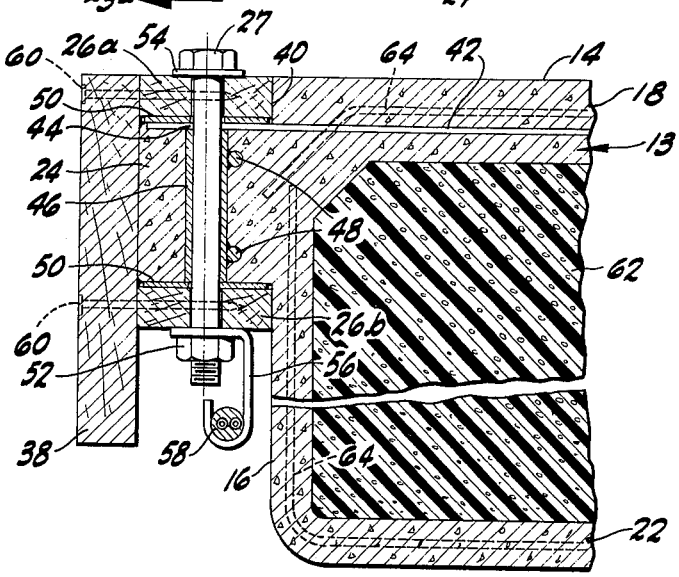
FIG. 3 is a cross-sectional view taken on the lines 3—3 in FIG. 1.

The interconnection of flange 24, unit-connecting stringers and buffer rail is shown most clearly in FIG. 3.

Referring now to the enlarged cross-sectional view of FIG. 3, the detail of the preferred manner of constructing the connection means is illustrated. The flange 24 is integrally cast with the concrete float unit 12 and projects from the sidewall 16 of the unit. To provide a substantially flat top surface after assembly, the concrete flange has an indented top corner edge 40 which provides a seating for the upper stringer 26*a*. For added strength at the point of the bolt connection, a transverse steel strap 42 is imbedded in the top of the cast concrete shell 13 of the float unit, as also shown in dotted line in FIG. 2. The transverse strap 42 projects across the indented corner edge 42 and includes a drilled hole 44 through which the bolt 27 is inserted. Imbedded in the flange is a vertically positioned sleeve 46. For structural strength, two reinforcing bars 48 run longitudinally along the length of the flange 24. The reinforcing bars 48 are welded against the sleeve 46 on either the outer side or, as shown, against the inner side of the sleeve 46. The sleeve is included to facilitate replacement of any bolts that fail under extreme environmental conditions. While stud bolts may be imbedded in the concrete flange with threaded projections at each end for fastening the stringers, which allow the same rigid interconnection to be achieved, the difficulty in replacing a bolt which has failed makes such arrangement less desirable than that shown.

Figure 2:
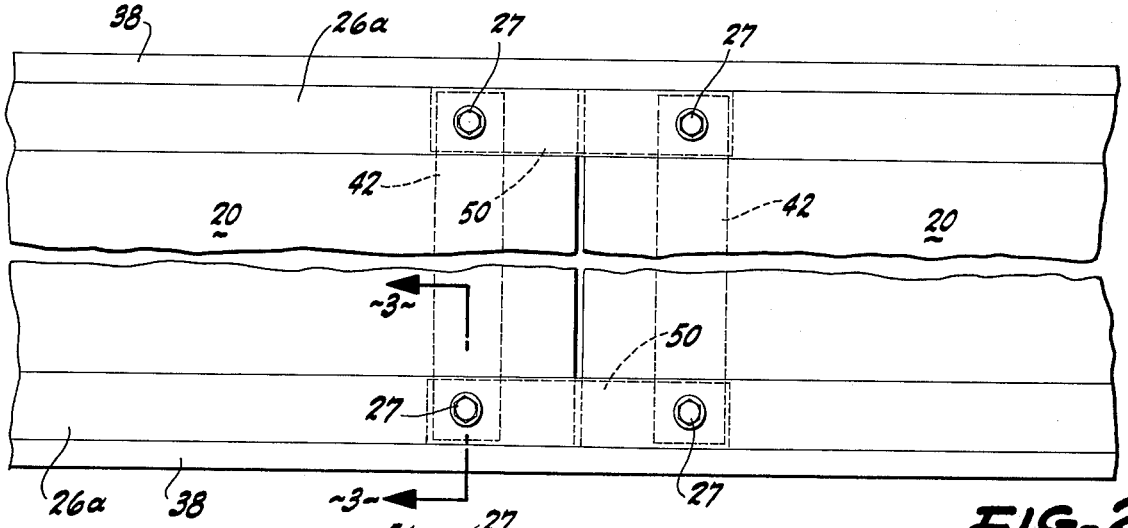
FIG. 2 is a top plan view, partially fragmented, of a typical connection between adjacent float units.

Since the stringers have their maximum strength in compression, a pair of longitudinal steel straps 50 are arranged against the top and bottom surfaces of the flange and extend across the juncture of adjacent float units to at least the first bolts 27 on each of the two adjacent units, as shown in dotted line in FIG. 2. The straps provide additional tensile strength to aid in the rigid interconnection of the float units. Against the straps 50 and the remaining exposed horizontal surfaces of the flange 24 are mounted the upper stringer 26*a* and the lower stringer 26*b*. The stringers, straps and flange are sandwiched together by the bolt 27 and tightened nut 52. In the preferred embodiment, a washer 54 is shown against the upper stringer 26*a* to properly seal the head of the bolt 27 against the wooden stringer. A utility bracket 56 provides the same function for the nut against the lower stringer 26*b*. The utility bracket 56 is used to support an electrical cable 58 which may provide lighting or dockside electrical outlets for boats moored at the wharf structure.

The wooden buffer rail 38 is fastened flat against the projecting surface edge formed by the two spaced stringers 26*a* and 26*b* and the flange. Fastening is simply accomplished by nailing the bumper to the stringers with spikes 60, shown in dotted line. For convenience, the buffer rail is segmented and runs the length of each individual float unit, or alternately, any length found convenient for assembly of the overall wharf structure.

As shown in the cross-sectional view of FIG. 3, the concrete float unit 14 is, in a manner of speaking, hollow. The concrete unit is fabricated around a polystyrene foam block 62 which, by its light weight, provides the buoyancy for the float unit. Use of the foam block permits the unit to float even though cracks develop in the concrete shell below the water line. The concrete shell 13 is preferably reinforced with light reinforcing rod 64, shown in dotted line, or alternately by wire mesh reinforcing screen.

The float units 12, as shown in FIG. 2, are arranged end-to-end 18 either in contact or spaced as shown, to allow for irregularities in the configuration of the concrete shell.

While in the foregoing specification an embodiment of the invention has been set forth in considerable detail for purposes of making a complete disclosure thereof, it will be apparent to those skilled in the art that numerous changes may be made in such details without departing from the spirit and principles of the invention.

What is claimed is:

1. In a float structure formed of a plurality of adjacently arranged interconnected float units, each float unit comprising an enclosed, substantially rectangular shell structure fabricated from a concrete material with opposed sides with sidewalls and ends with end walls, a top and a bottom, a means of interconnecting said float unit, comprising: flange structures on said float units comprising a portion of said sidewalls horizontally projecting from said sidewalls and extending the length of said sidewalls, said flange structures having a horizontal top mounting surface and a horizontal bottom mounting surface spaced from said top surface; connection members for connecting at least two of said float units together with ends abutting, said connection members comprising upper stringers mounted against said top mounting surface of said flange structures and lower stringers mounted against said bottom mounting surface of said flange structures, said stringers extending longitudinally along at least a portion of the flange structures of at least two adjacent float units; and, fastening means each vertically extending through said flange structures and the upper and lower stringers for securing said upper stringers, said flange structures and said lower stringers together in compression.

2. The apparatus of claim 1 wherein said fastening means comprises bolts and nuts which sandwich said upper stringers, said flange structures and said lower stringers together.

3. The apparatus of claim 2 wherein said fastening means comprises further tubular elements each being embedded in said flange structure extending between said top mounting surface and said bottom mounting surface through which said bolts extend.

4. The apparatus of claim 3 wherein said tubular elements are secured to structural reinforcing elements imbedded in said flange structure.

5. The apparatus of claim 1 comprising further buffer rails fastened against said upper stringer and said lower stringer.

6. The apparatus of claim 1 wherein said stringers are fabricated from a wood material.

7. The apparatus of claim 1 having further a lightweight float material wherein said shell structure encompasses said float material.

8. The apparatus of claim 1 comprising further reinforcing straps mounted against said top mounting surface and the bottom mounting surface of said flange structures, said straps extending longitudinally along at least a portion of the flange structures of at least two adjacent float units between said flange structures and said stringers.

9. The apparatus of claim 8 comprising further reinforcing straps imbedded in said concrete shell structure transversely across said float units having a first end portion intersecting the reinforcing straps mounted against the top mounting surface on one side of the float units and a second end portion intersecting the reinforcing straps mounted against the top mounting surface on the other side of the float units.

10. The apparatus of claim 9 wherein said fastening means extend through said reinforcing straps at said intersections.

11. A float structure comprising: a plurality of adjacently arranged interconnected float units, each float unit comprising an enclosed, substantially rectangular shell structure with opposed sides with sidewalls and ends with end walls, a top and a bottom; a means of interconnecting said float units, comprising flange structures on said float units having a portion of said sidewalls horizontally projecting from said sidewalls and extending the length of said sidewalls, said flange structures having a horizontal top mounting surface and a horizontal bottom mounting surface spaced from said top surface, connection members for connecting at least two of said float units together with ends abutting, said connection members comprising upper stringers mounted against said top mounting surface of said flange structures and lower stringers mounted against said bottom mounting surface of said flange structures, said stringers extending longitudinally along at least a portion of the flange structures of at least two adjacent float units and fastening means including rod elements each vertically extending through said flange structures between said top mounting surface and said bottom mounting surface and through the upper and lower stringers for securing said upper stringers, said flange structures and said lower stringers together in compression.

12. The apparatus of claim 2 wherein said fastening means comprises further tubular elements each being embedded in said flange structure extending between said top mounting surface and said bottom mounting surface through which said rod elements extend.

* * * * *